US008272797B2

(12) United States Patent
Morimoto et al.

(10) Patent No.: US 8,272,797 B2
(45) Date of Patent: Sep. 25, 2012

(54) PRINTER

(75) Inventors: Toshiyasu Morimoto, Kanagawa (JP); Ken Higuchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 728 days.

(21) Appl. No.: 12/360,559

(22) Filed: Jan. 27, 2009

(65) Prior Publication Data

US 2009/0196672 A1 Aug. 6, 2009

(30) Foreign Application Priority Data

Feb. 1, 2008 (JP) ..... 2008-022502

(51) Int. Cl.
*B41J 15/00* (2006.01)

(52) U.S. Cl. ..... 400/621; 400/611

(58) Field of Classification Search ..... 400/621
See application file for complete search history.

(56) References Cited

U.S. PATENT DOCUMENTS 6,408,750 B1 * 6/2002 Goto et al. ..... 101/226
7,395,744 B2 * 7/2008 Connor ..... 83/106

FOREIGN PATENT DOCUMENTS

JP 2001-139212 5/2001
JP 2003-326783 11/2003

* cited by examiner

*Primary Examiner* — Seung Lee
*Assistant Examiner* — Christopher Stanford
(74) *Attorney, Agent, or Firm* — SNR Denton US LLP

(57) ABSTRACT

A printer includes a fragment receiving section provided below a cutter and receiving a non-printing area cut off as a fragment falling thereinto, and a printed matter receiving section provided below the cutter and receiving a printing area cut off as a piece of printed matter and falling thereinto. The fragment receiving section includes a rocking plate rocked by a rocking mechanism between a first rocking position, where an upper end of the rocking plate resides on the downstream side in a paper conveying direction with respect to a cutting position so as to allow the fragment to fall into the fragment receiving section, and a second rocking position, where the upper end of the rocking plate resides on the upstream side in the paper conveying direction with respect to the cutting position so as to guide the piece of printed matter into the printed matter receiving section.

8 Claims, 13 Drawing Sheets

PRINTER

CROSS REFERENCES TO RELATED APPLICATIONS

The present invention contains subject matter related to Japanese Patent Application JP 2008-022502 filed in the Japanese Patent Office on Feb. 1, 2008, the entire contents of which are incorporated herein by reference.

BACKGROUND OF THE INVENTION

1. Field of the Invention

The present invention relates to printers, and in particular to printers that each include a fragment receiving section configured to receive fragments that are cut off with a cutter as non-printing areas and a printed matter receiving section configured to receive pieces of printed matter that are cut off with the cutter as printing areas.

2. Description of the Related Art

In recent years, there have been provided printers using roll paper, which provides high image quality and is cost-advantageous.

Roll paper is a long sheet of recording paper rolled up around a paper core and, when printing is performed thereon, is unrolled by a predetermined length for every print and is cut into a piece having a specified length after every print.

Specifically, since the recording paper has printing areas and non-printing areas that are alternately sectioned thereon, the recording paper is to be cut into separate groups of the printing areas and the non-printing areas.

Therefore, such a printer includes a cutter, a fragment receiving section configured to receive fragments that are cut off with the cutter as non-printing areas, and a printed matter receiving section configured to receive pieces of printed matter that are cut off with the cutter as printing areas.

Not only in printers using roll paper but also in printers capable of borderless printing, non-printing areas, which are unwanted, are cut off in a downstream process. Therefore, printers capable of borderless printing also each include a cutter, a segment receiving section, and a printed matter receiving section, as in the case of printers using roll paper.

Such related-art printers each include an output roller disposed between the cutter and an output tray. A piece of printed matter that has been cut off by the cutter is conveyed by the output roller to the output tray. Conveying paths for printed matter and for fragments are separated with a flap. Exemplary printers are disclosed in Japanese Unexamined Patent Application Publication Nos. 2001-139212 and 2003-326783.

SUMMARY OF THE INVENTION

Each of the related-art printers including the output roller between the cutter and the output tray, however, also includes a mechanism that drives the output roller. This is disadvantageous in reducing the number of printer components and the size of the printer.

In light of the above, it is desirable that the present invention provide a printer that is capable of assuredly separating cut pieces of printed matter and fragments and is advantageous in terms of size reduction by having a simple configuration.

According to an embodiment of the present invention, a printer includes a conveying section conveying paper having a width and a length orthogonal to the width, the paper having a printing area and a non-printing area provided thereon next to each other in a direction of the length and being conveyed in the direction of the length; a cutter cutting the paper conveyed thereto in such a manner as to separate the printing area and the non-printing area; a fragment receiving section provided below the cutter and receiving the non-printing area cut off as a fragment by the cutter and falling thereinto; and a printed matter receiving section provided below the cutter and on a downstream side in a paper conveying direction with respect to the fragment receiving section, and receiving the printing area cut off as a piece of printed matter by the cutter and falling thereinto. The fragment receiving section includes a rocking plate provided at a position below a cutting position where the cutter cuts the paper and on the downstream side in the paper conveying direction with respect to the cutting position, the rocking plate being rockable about an axis parallel to a direction of the width of the paper. The rocking plate is rocked by a rocking mechanism between a first rocking position, where an upper end of the rocking plate resides on the downstream side in the paper conveying direction with respect to the cutting position so as to allow the fragment to fall into the fragment receiving section, and a second rocking position, where the upper end of the rocking plate resides on an upstream side in the paper conveying direction with respect to the cutting position so as to guide the piece of printed matter into the printed matter receiving section.

In the embodiment of the present invention, the rocking plate is rocked between the first and second rocking positions.

When the rocking plate is rocked to the first rocking position, a non-printing area is cut off by the cutter, whereby the non-printing area as a fragment falls into the fragment receiving section provided therebelow.

When the rocking plate is rocked to the second rocking position, a printing area is cut off by the cutter, whereby the printing area as a piece of printed matter falls onto the rocking plate residing therebelow and is guided therealong into the printed matter receiving section.

In the printer according to the embodiment of the present invention, cut pieces of printed matter and fragments can be assuredly separated into respective groups with a simple configuration.

DESCRIPTION OF THE PREFERRED EMBODIMENTS

Embodiments of the present invention will now be described with reference to the drawings.

The basic configuration of a printer 10 according to a general embodiment of the present invention will be described.

Figure 1:
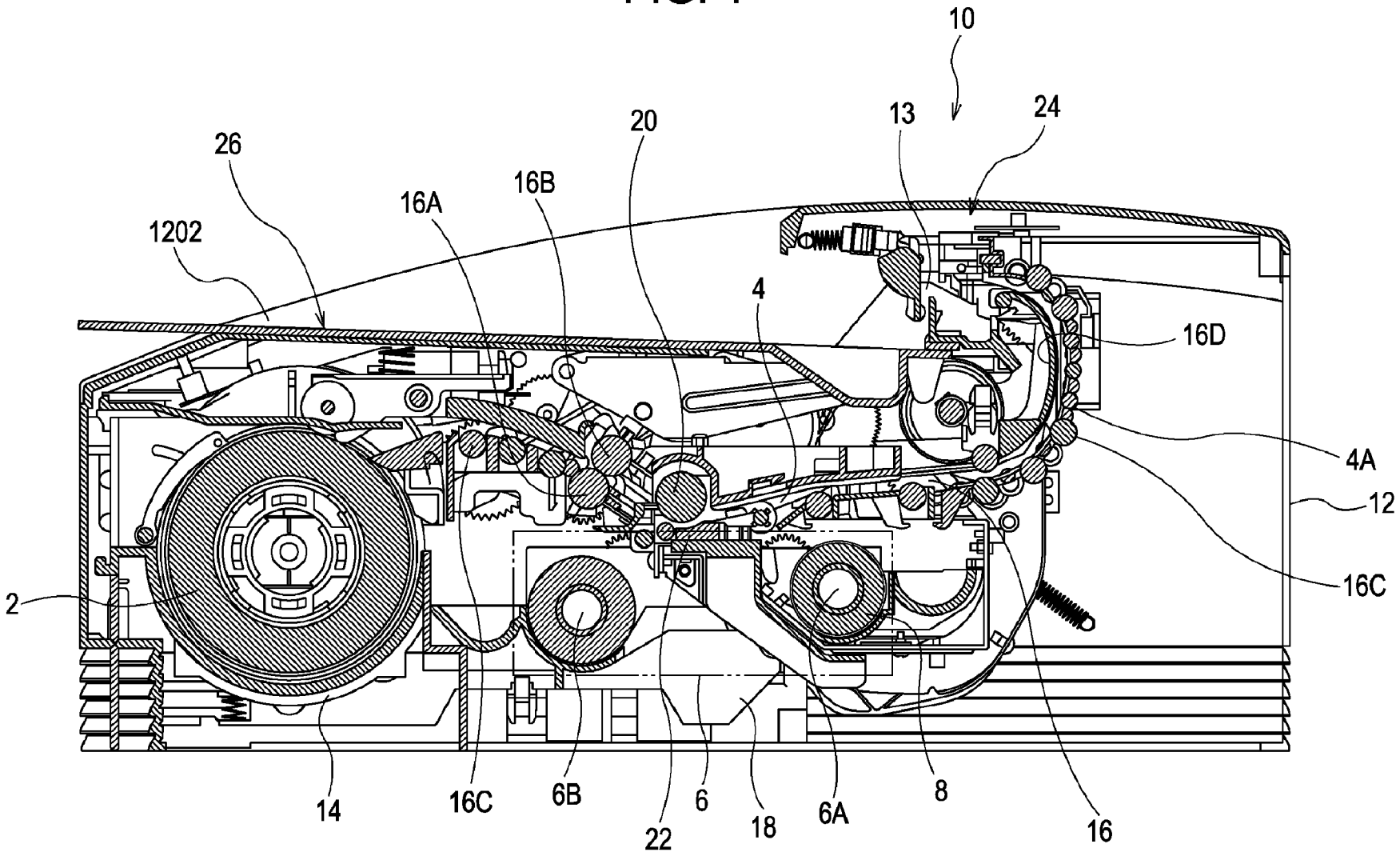
FIG. 1 is a cross-sectional view of a printer 10 according to a general embodiment of the present invention.
Figure 2:
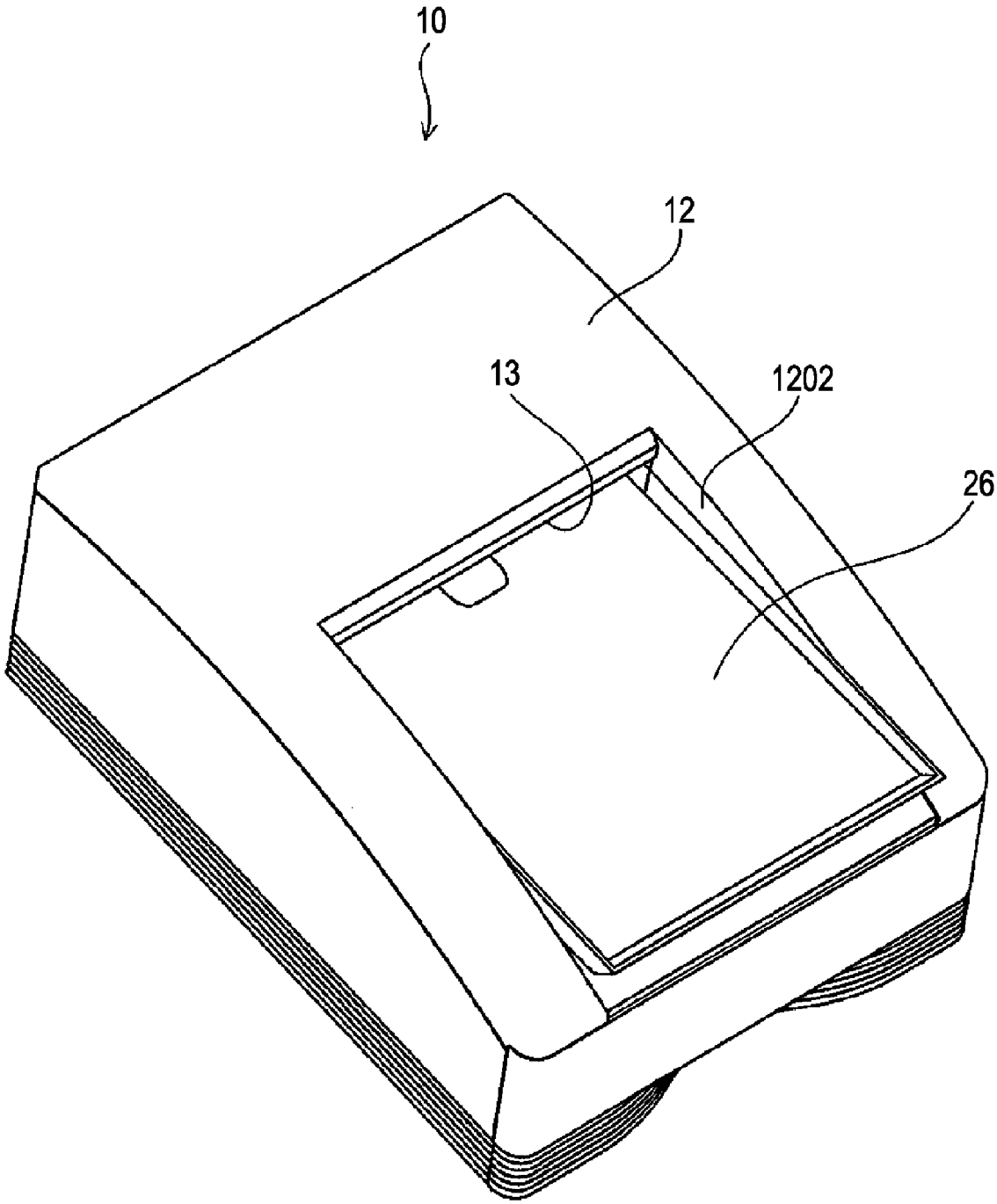
FIG. 2 is a perspective view of the printer 10 with an output tray 26 attached thereto.
Figure 3:
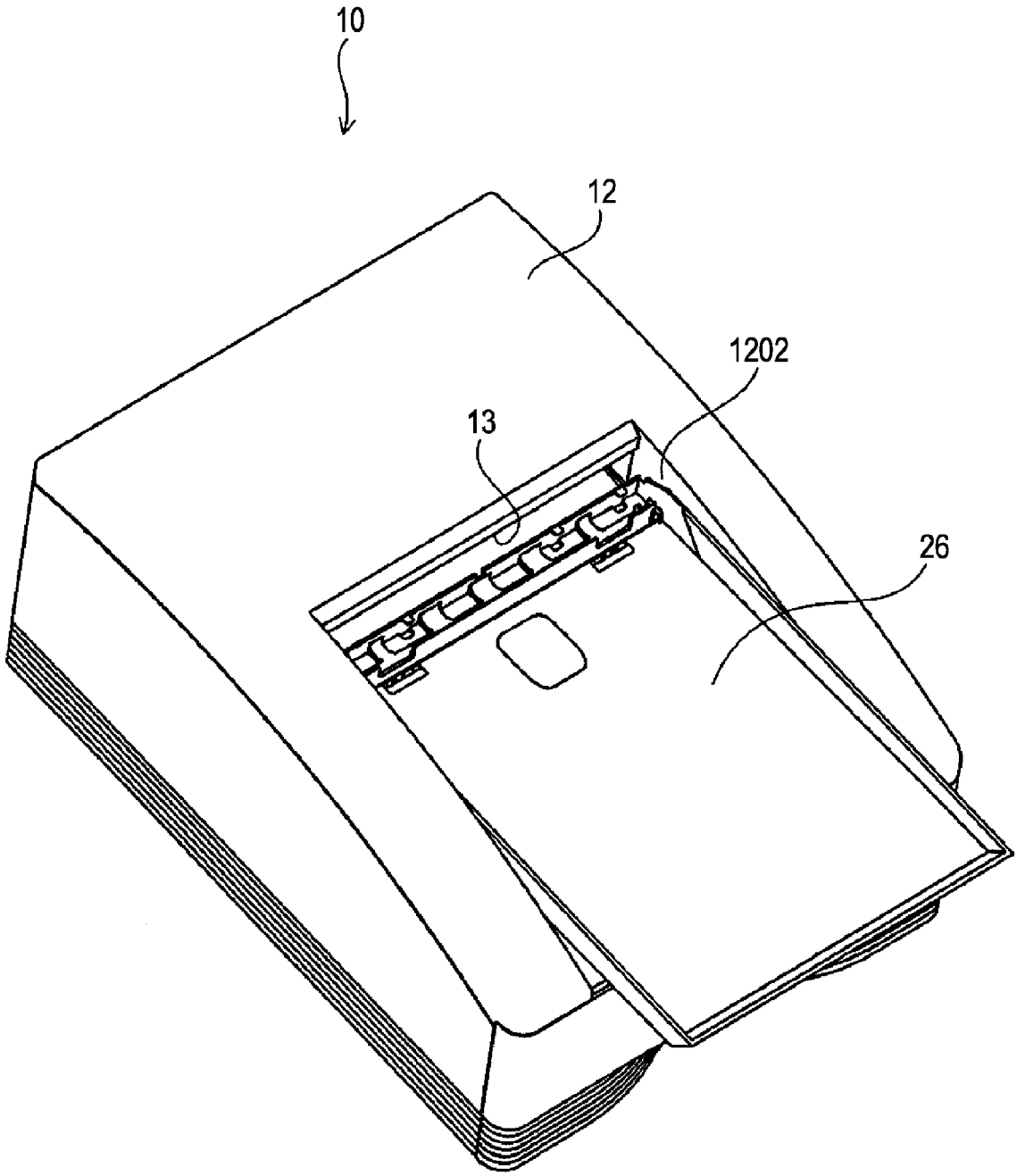
FIG. 3 is a perspective view of the printer 10 with the output tray 26 detached therefrom.

FIG. 1 is a cross-sectional view of the printer 10 according to the general embodiment. FIG. 2 is a perspective view of the printer 10 with an output tray 26 attached thereto. FIG. 3 is a perspective view of the printer 10 with the output tray 26 detached therefrom.

The printer 10 of the general embodiment is a dye-sublimation thermal printer, in which sublimation dye applied to an ink ribbon is sublimed and is transferred onto recording paper, whereby an image is printed.

Referring to FIGS. 2 and 3, the printer 10 includes a housing 12 and a tray receiving recess 1202 provided in the upper surface of the housing 12. The output tray 26 is detachably fitted in the tray receiving recess 1202.

The housing 12 has an output slot 13 provided therein at a position facing the output tray 26 fitted in the tray receiving recess 1202.

Referring to FIG. 1, the housing 12 houses a recording paper holder 14, a conveying section 16, an ink ribbon cassette holder 18, a platen roller 20, a print head 22, a cutter 24, and so forth.

The recording paper holder 14 holds recording paper (roll paper) 2, which has a width and a length orthogonal to the width, rolled up in the length direction thereof around a paper core. A roll of the recording paper 2 is placed in the recording paper holder 14 through a loading slot (not shown) provided in the housing 12.

The conveying section 16 conveys a portion of the recording paper 2 that is unrolled from the roll of the recording paper 2 held in the recording paper holder 14, in either a forward direction in which the unrolled portion is guided along a conveying path 4 via the print head 22 to the cutter 24, or a backward direction, opposite to the forward direction, in which the unrolled portion of the recording paper 2 lying on the conveying path 4 is rolled into the roll of the recording paper 2.

Hereinafter, the direction in which the recording paper 2 is conveyed forward is referred to as the conveying direction.

In the general embodiment, a part of the conveying path 4 from the recording paper holder 14 to the print head 22 extends in a substantially horizontal direction. The remaining part, the continuation of the foregoing part, of the conveying path 4 from the print head 22 to the cutter 24 turns around by 180 degrees with a U-shaped curve, forming a turnaround 4A.

Since the conveying path 4 has the turnaround 4A, the space in the housing 12 can be utilized efficiently. This of course leads to reduction in the size of the housing 12. In addition, it is advantageous in terms of reduction in the space for placing the housing 12, because the output tray 26 can be arranged on the top of the housing 12, a dead space.

The conveying section 16 includes a pinch roller 16A, a capstan 16B, a plurality of guide rollers 16C, a guide member 16D, and so forth. The pinch roller 16A and the capstan 16B in combination rotate in the forward or backward direction while pinching the recording paper 2 in the thickness direction thereof, thereby conveying the recording paper 2 in the forward or backward direction.

The ink ribbon cassette holder 18 detachably holds an ink ribbon cassette 6 containing an ink ribbon 8 on which ink of different colors is applied in respective sections.

The ink ribbon 8 that is drawn from an ink ribbon supply reel 6A provided in the ink ribbon cassette 6 is guided by a guide roller (not shown), passes through a position between the platen roller 20 and the print head 22, and is wound up onto an ink ribbon winding reel 6B provided in the ink ribbon cassette 6.

The platen roller 20 and the print head 22 face each other with the conveying path 4 defined therebetween.

The platen roller 20 is in contact with the recording paper 2 at the outer surface thereof. The ink ribbon 8 resides across the recording paper 2 from the platen roller 20. That is, the ink ribbon 8 resides between the recording paper 2 and the print head 22.

The print head 22 is movable between a printing position, where the print head 22 in combination with the platen roller 20 causes the ink ribbon 8 to be pressed against the recording paper 2 by being positioned in proximity to the platen roller 20, and a standby position, where the print head 22 is positioned away from the platen roller 20 so as not to cause the ink ribbon 8 to be pressed against the recording paper 2.

Printing is performed in the following manner. While the recording paper 2 is conveyed through the conveying section 16, the print head 22 is moved to the printing position. In this state, a plurality of heating elements provided on the print head 22 are selectively driven by applying current in accordance with gray-scale data, whereby sublimation dye on the ink ribbon 8 is sublimed and is transferred onto the recording paper 2.

More specifically, in the general embodiment, the recording paper 2 is first conveyed by the conveying section 16, with the print head 22 positioned at the standby position, in the forward direction by a predetermined length, and then is conveyed by the conveying section 16, with the print head 22 positioned at the printing position, in the backward direction by a predetermined length. During the backward conveyance of the recording paper 2, the print head 22 is driven, whereby printing is performed.

While the recording paper 2 pinched between the pinch roller 16A and the capstan 16B is conveyed in the backward direction, printing is performed on a printing area. In this case, a non-printing area having no printed images over the entire width of the recording paper 2 is inserted between printing areas for a reason described below.

Therefore, printing areas and non-printing areas are alternately provided in the length direction of the recording paper 2.

Non-printing areas are provided because of the following reason. In performing printing on the recording paper 2, the recording paper 2 is first conveyed in the forward direction by a length calculated as the sum of a length of a printing area and a predetermined length (several millimeters, for example) as a non-printing area, and then is conveyed in the backward direction while printing is performed by the print head 22.

If printing is performed in a state where the leading end of the recording paper 2 that is being conveyed has not reached the print head 22, the print head 22 is damaged. To prevent such a situation, non-printing areas of a predetermined length are provided.

The cutter 24 is provided at the output slot 13 and cuts the recording paper 2 into separate pieces of recording areas and non-recording areas. Recording areas cut out of the recording paper 2 by the cutter 24 are treated as printed matter 28. Non-recording areas cut out of the recording paper 2 by the cutter 24 are treated as fragments 30.

Figure 8:
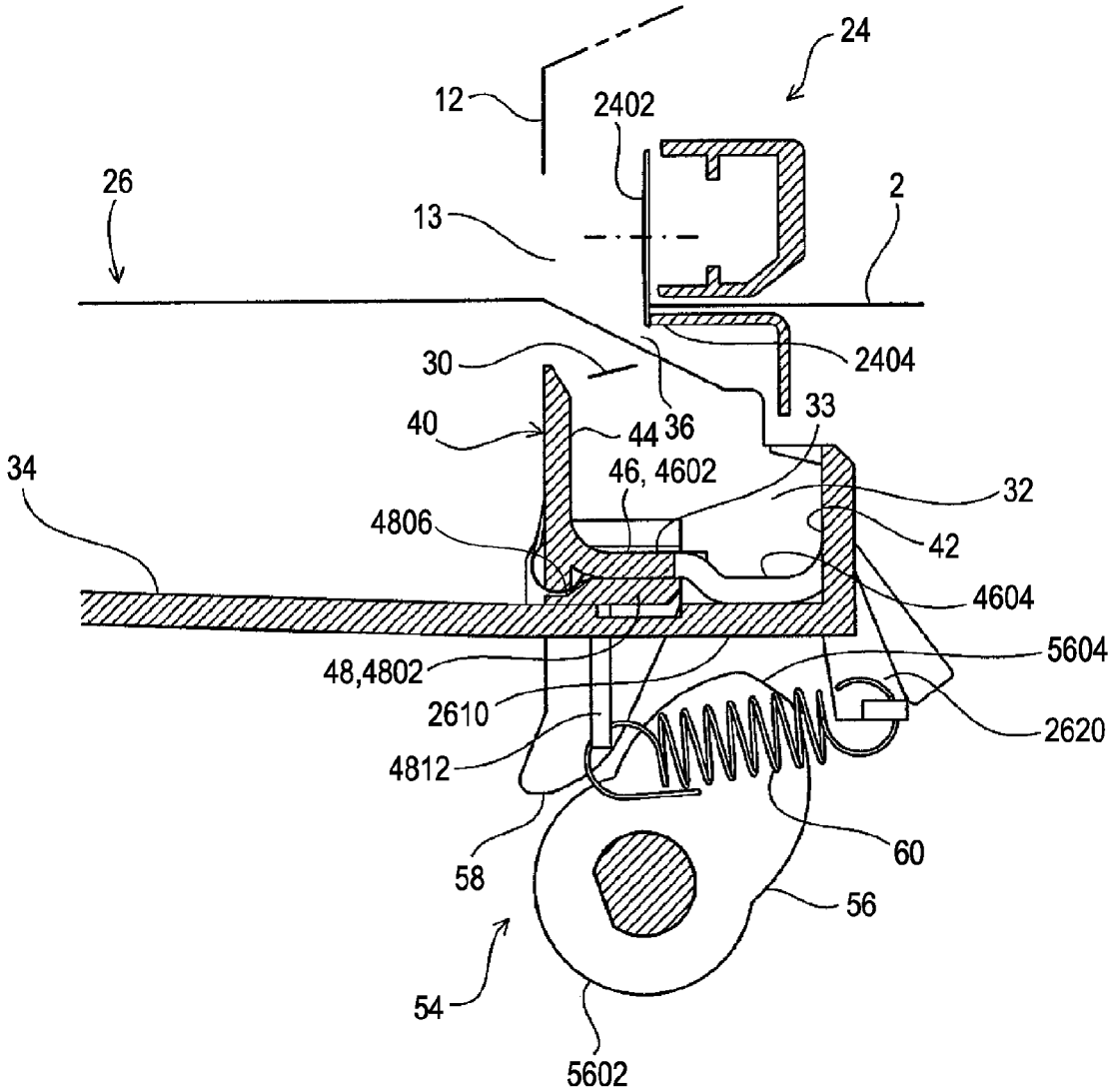
FIG. 8 shows the first rocking position of the rocking plate 40.

Referring to FIG. 8, the cutter 24 includes a circular rotary blade 2402 configured to rotate on its axis of rotation while moving in the width direction of the recording paper 2, and a fixed blade 2404 extending in the width direction of the recording paper 2 and along which the rotary blade 2402 moves. The rotary blade 2402 rotates while moving along and being in contact with the fixed blade 2404, whereby the recording paper 2 is cut. The cutter 24 is not limited to such a configuration having a rotary mechanism in which a blade is rotated, and may have any of other various related-art mechanisms.

In the general embodiment, a position where the rotary blade 2402 rotates while moving along and being in contact with the fixed blade 2404 is defined as a cutting position 36 where the cutter 24 cuts the recording paper 2.

Major features in the general embodiment of the present invention will be described.

Figure 4:
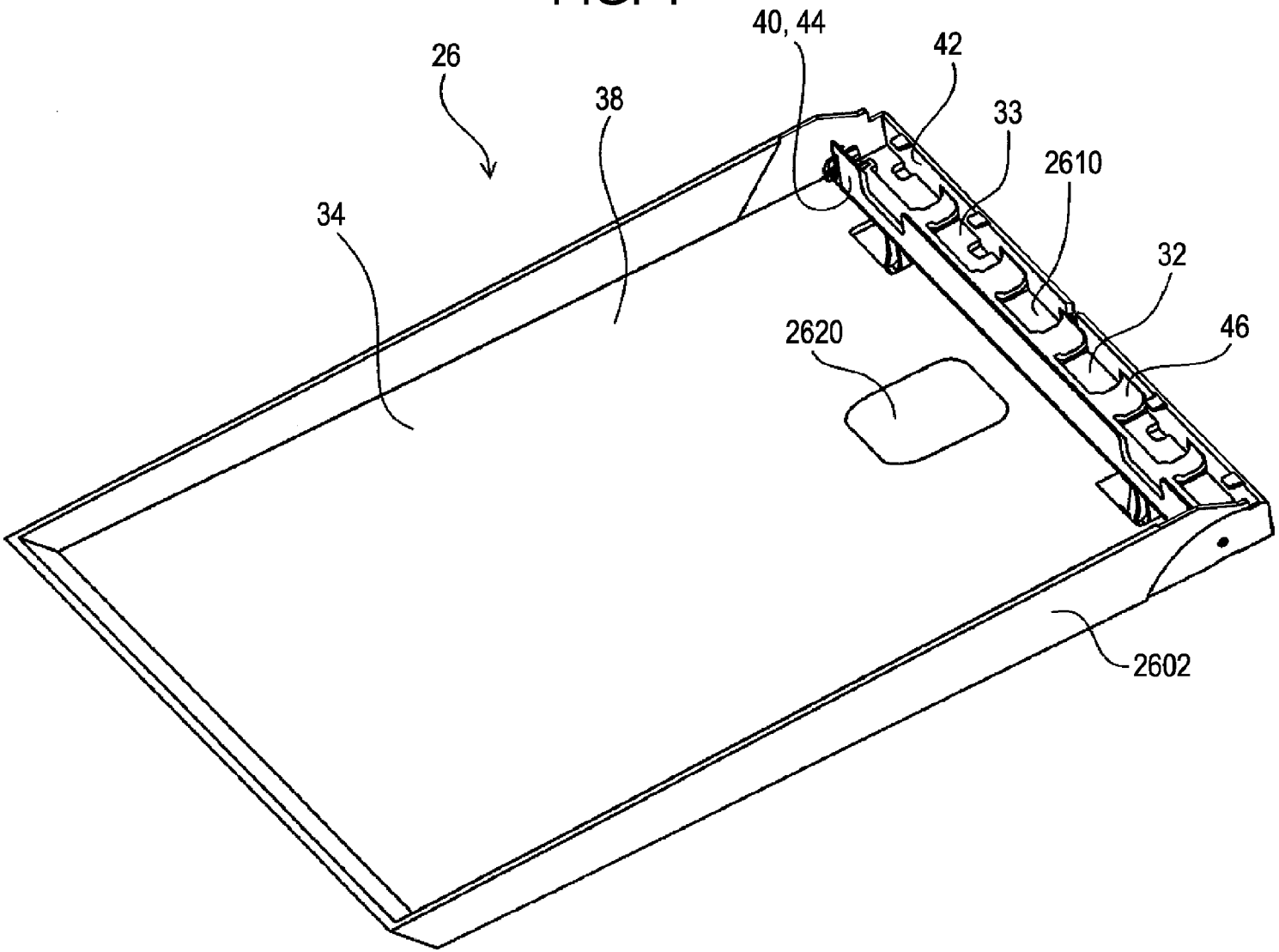
FIG. 4 is a perspective view of the output tray 26 with a rocking plate 40 positioned at a first rocking position.
Figure 5:
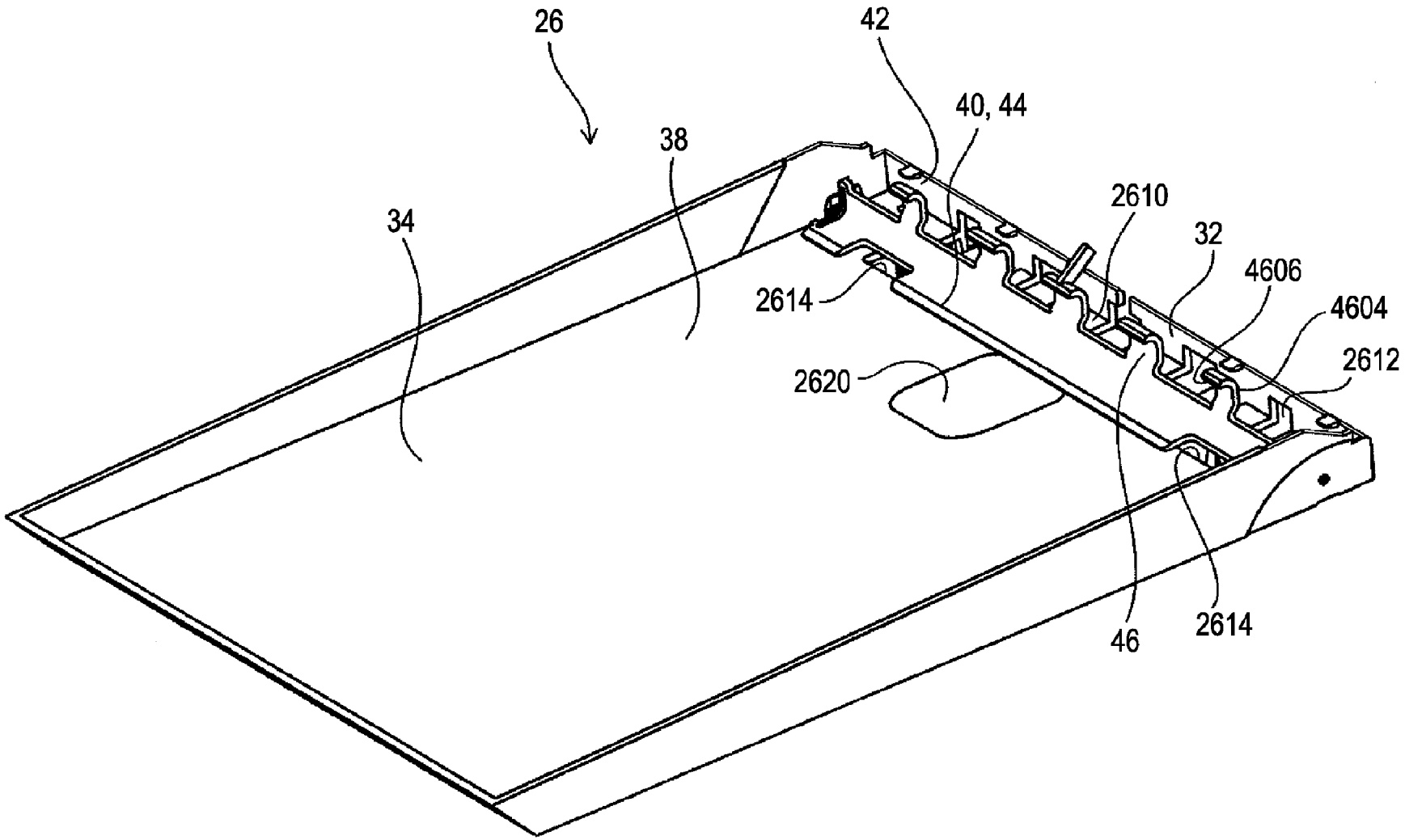
FIG. 5 is a perspective view of the output tray 26 with the rocking plate 40 positioned at a third rocking position.
Figure 6:
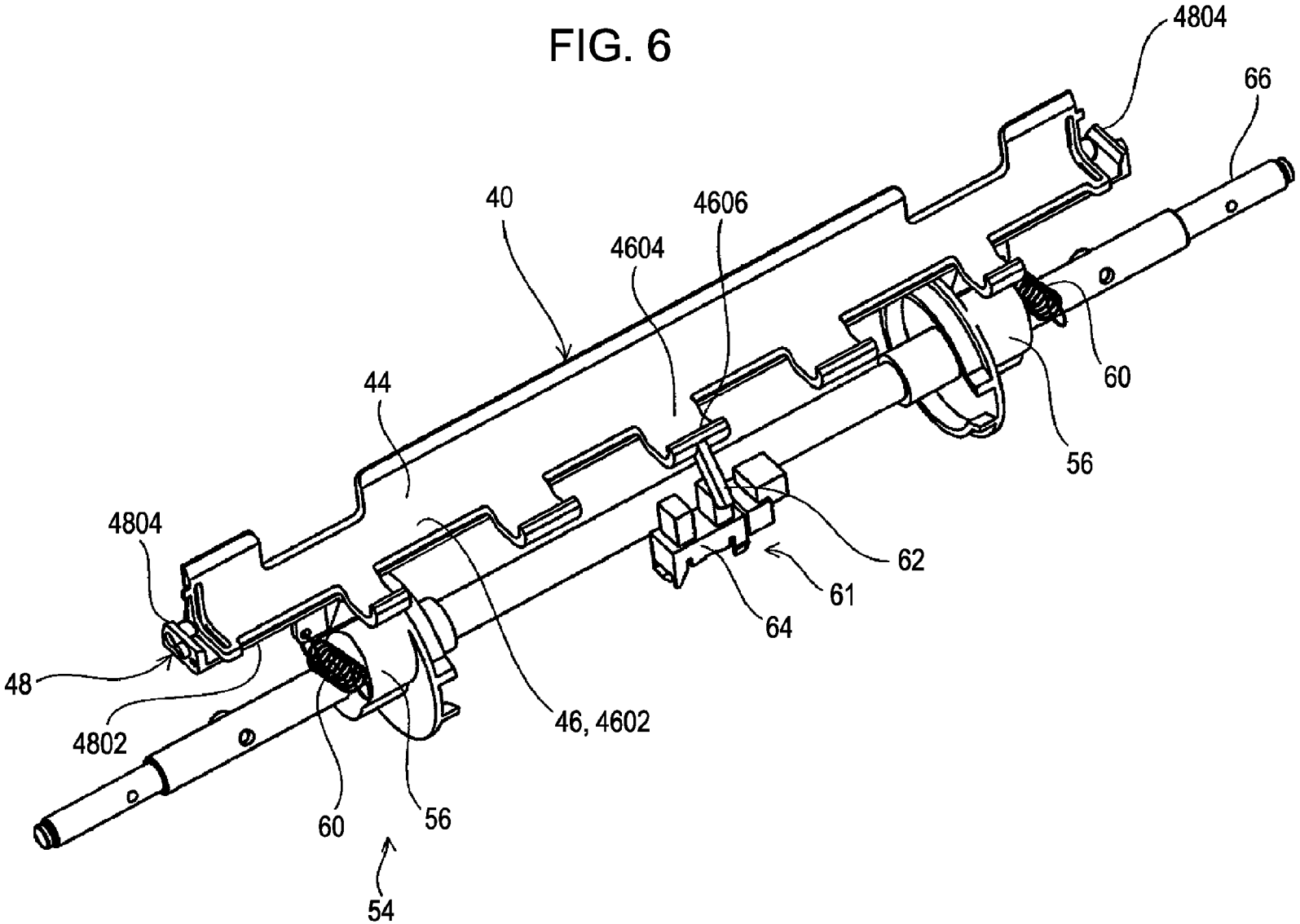
FIG. 6 is a perspective view showing the rocking plate 40, a movable member 48, and a rocking mechanism 54.
Figure 7:
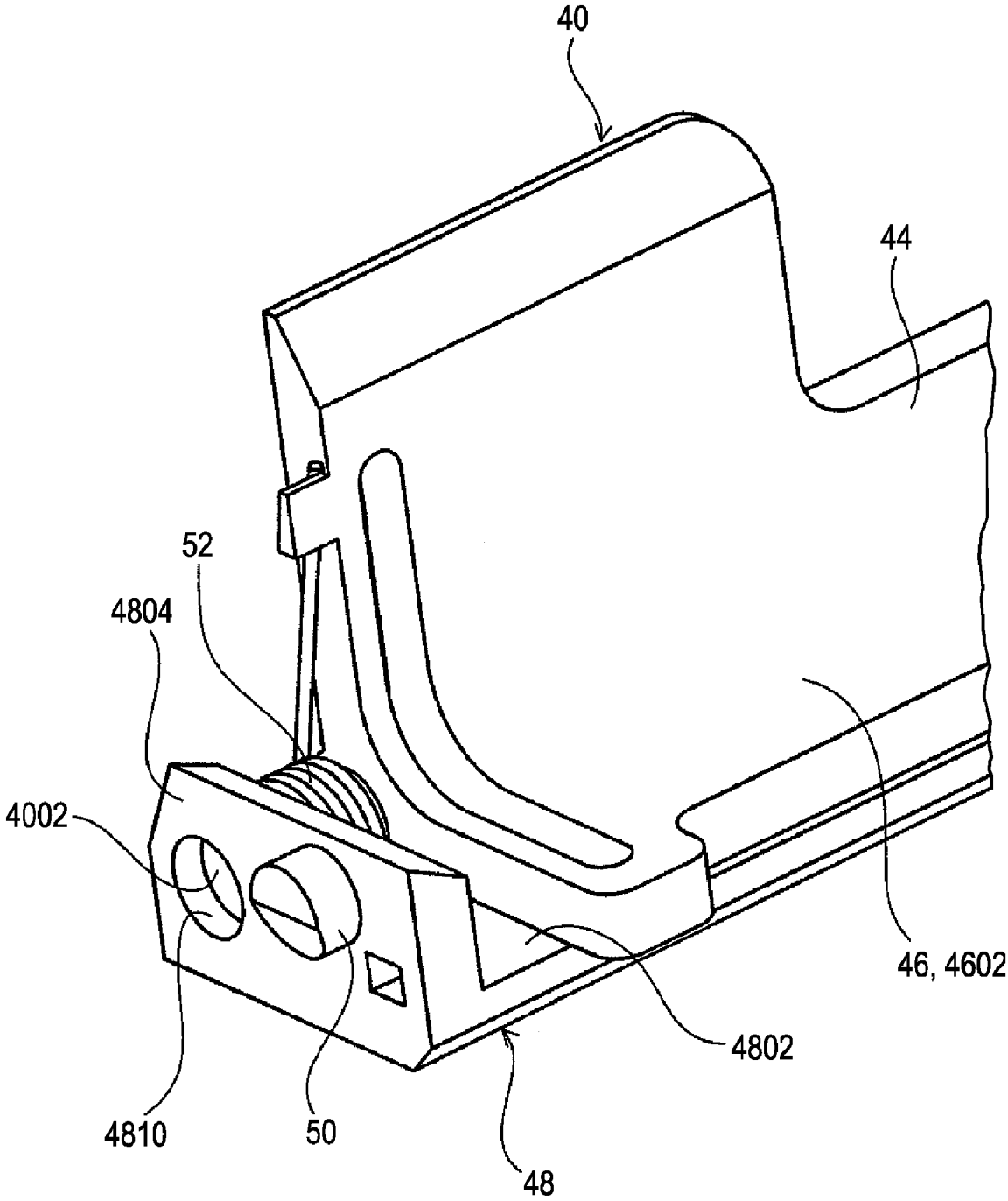
FIG. 7 is a perspective view showing the rocking plate 40 and the movable member 48.

FIG. 4 is a perspective view of the output tray 26 with a rocking plate 40 positioned at a first rocking position. FIG. 5 is a perspective view of the output tray 26 with the rocking plate 40 positioned at a third rocking position. FIG. 6 is a perspective view showing the rocking plate 40, a movable member 48, and a rocking mechanism 54. FIG. 7 is a perspective view showing the rocking plate 40 and the movable member 48.

Figure 9:
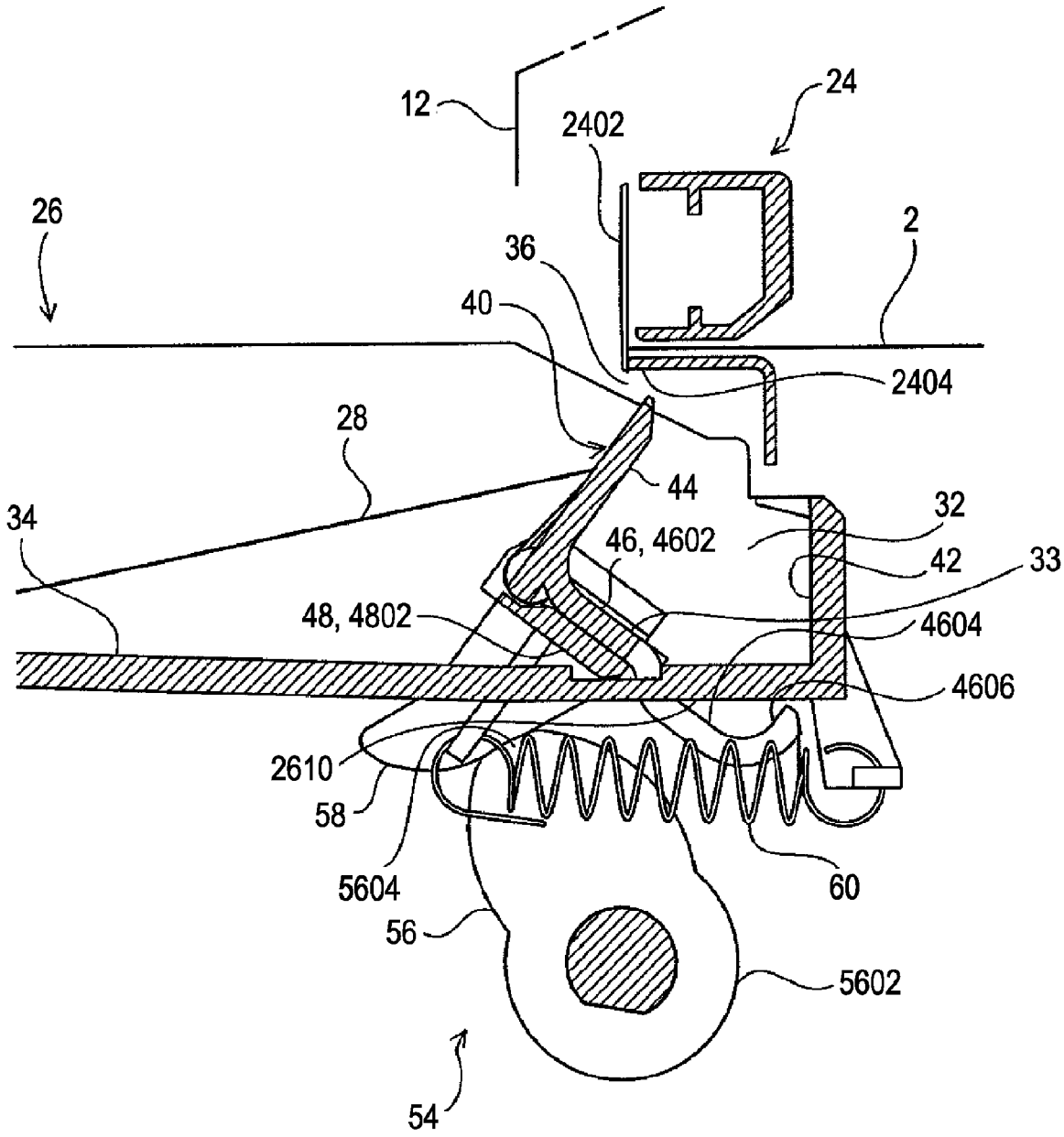
FIG. 9 shows a second rocking position of the rocking plate 40.

FIG. 8 shows the first rocking position of the rocking plate 40. FIG. 9 shows a second rocking position of the rocking plate 40.

Figure 10:
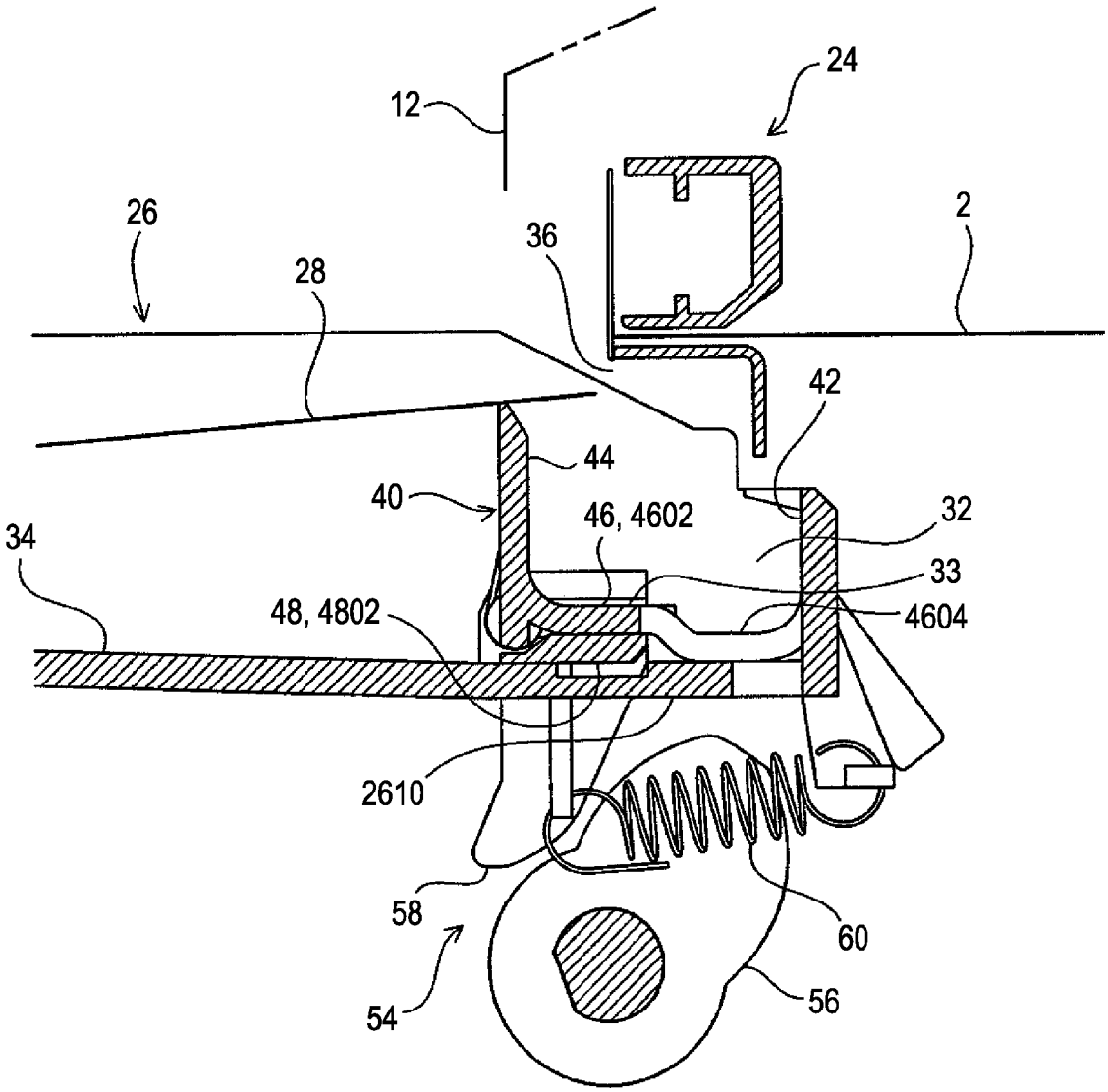
FIG. 10 shows a state where a piece of printed matter is cut out of the recording paper 2 when the rocking plate 40 is at the first rocking position.
Figure 11:
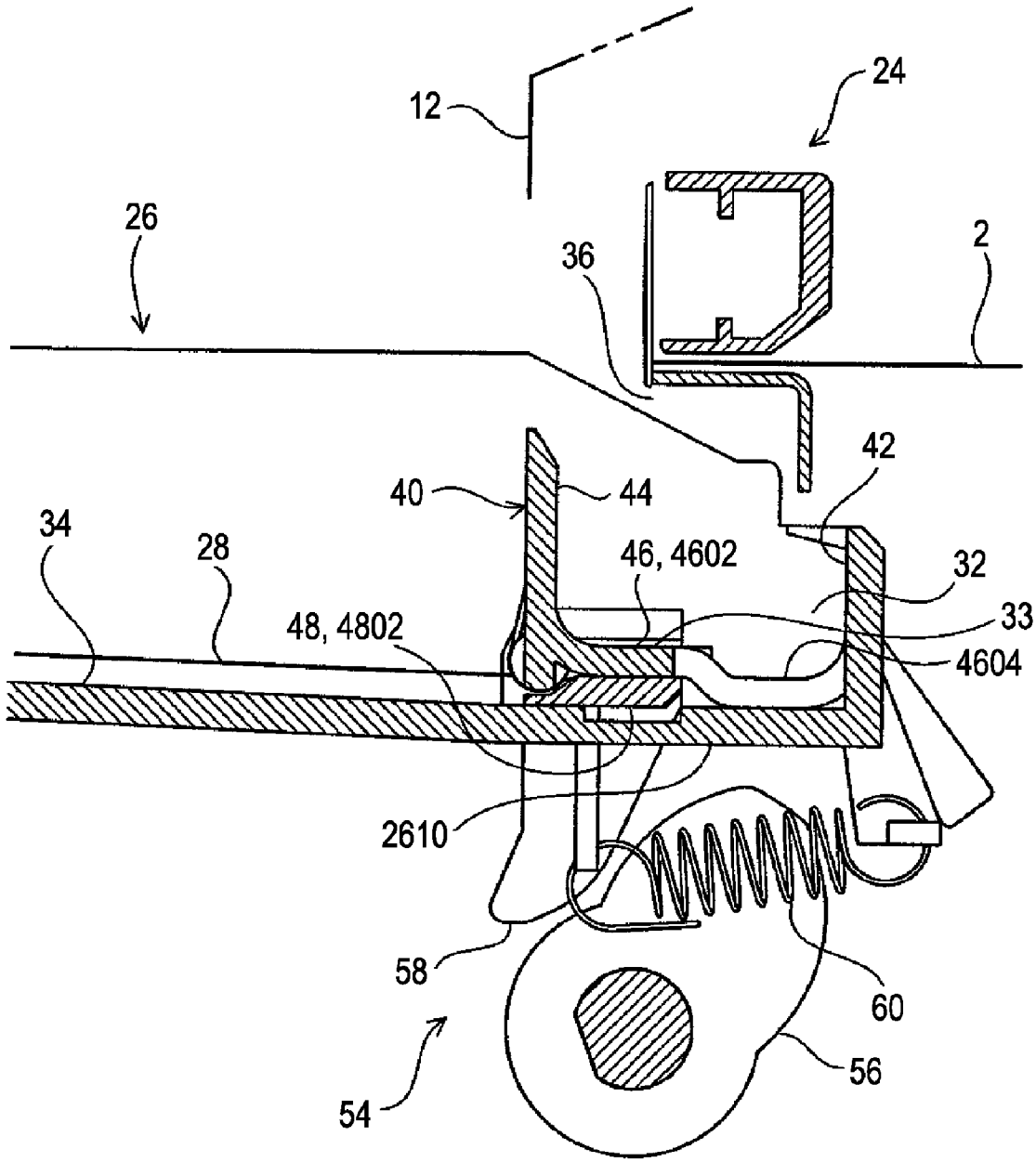
FIG. 11 shows a state where the piece of printed matter is placed in a printed matter receiving section 34 by rocking the rocking plate 40 from the second rocking position to the first rocking position.

FIG. 10 shows a state where a piece of printed matter 28 is cut out of the recording paper 2 when the rocking plate 40 is at the first rocking position. FIG. 11 shows a state where the piece of printed matter 28 is placed in a printed matter receiving section 34 by rocking the rocking plate 40 from the second rocking position to the first rocking position.

Figure 12:
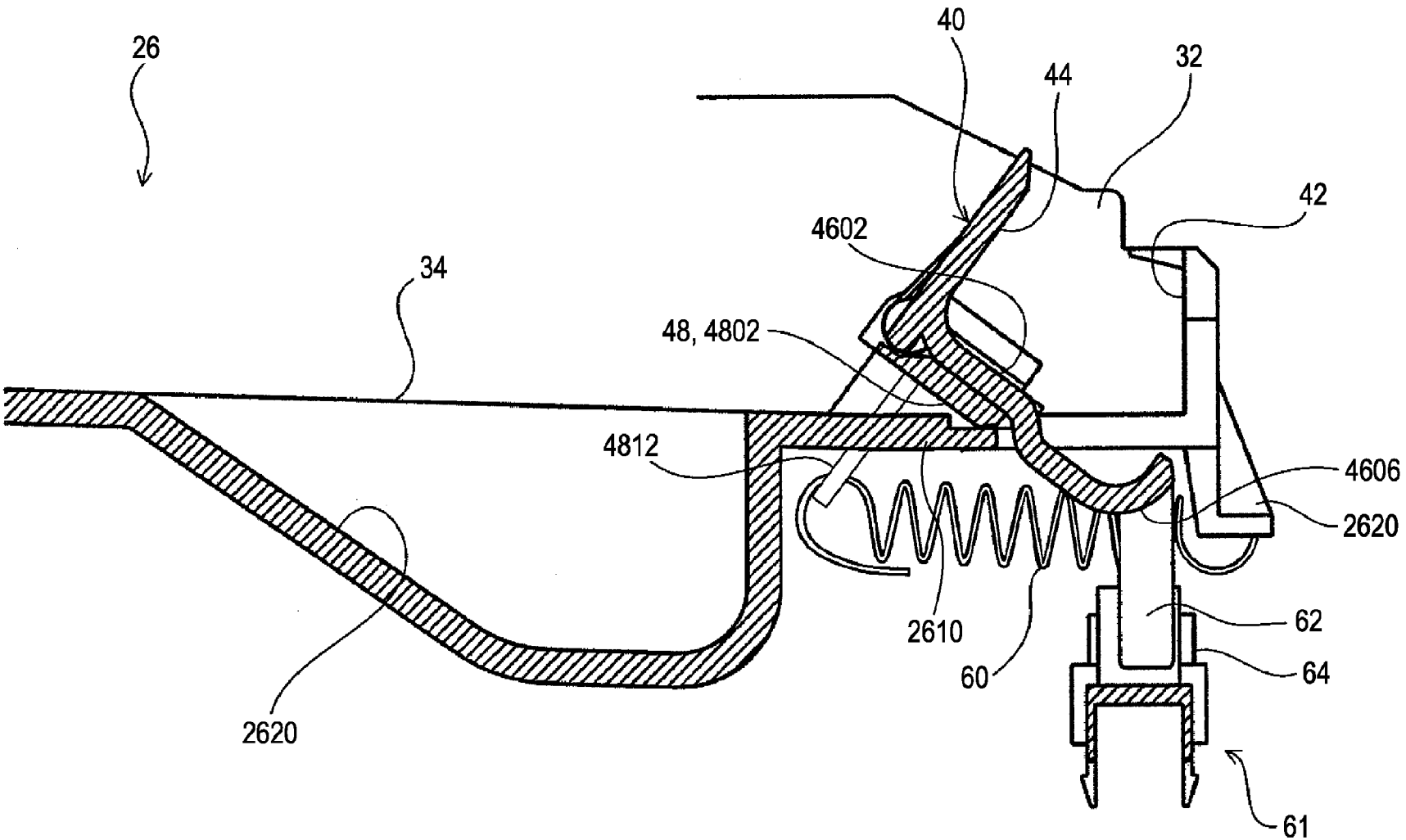
FIG. 12 shows a state of the rocking plate 40 at the second rocking position when a fragment receiving section 32 is empty.
Figure 13:
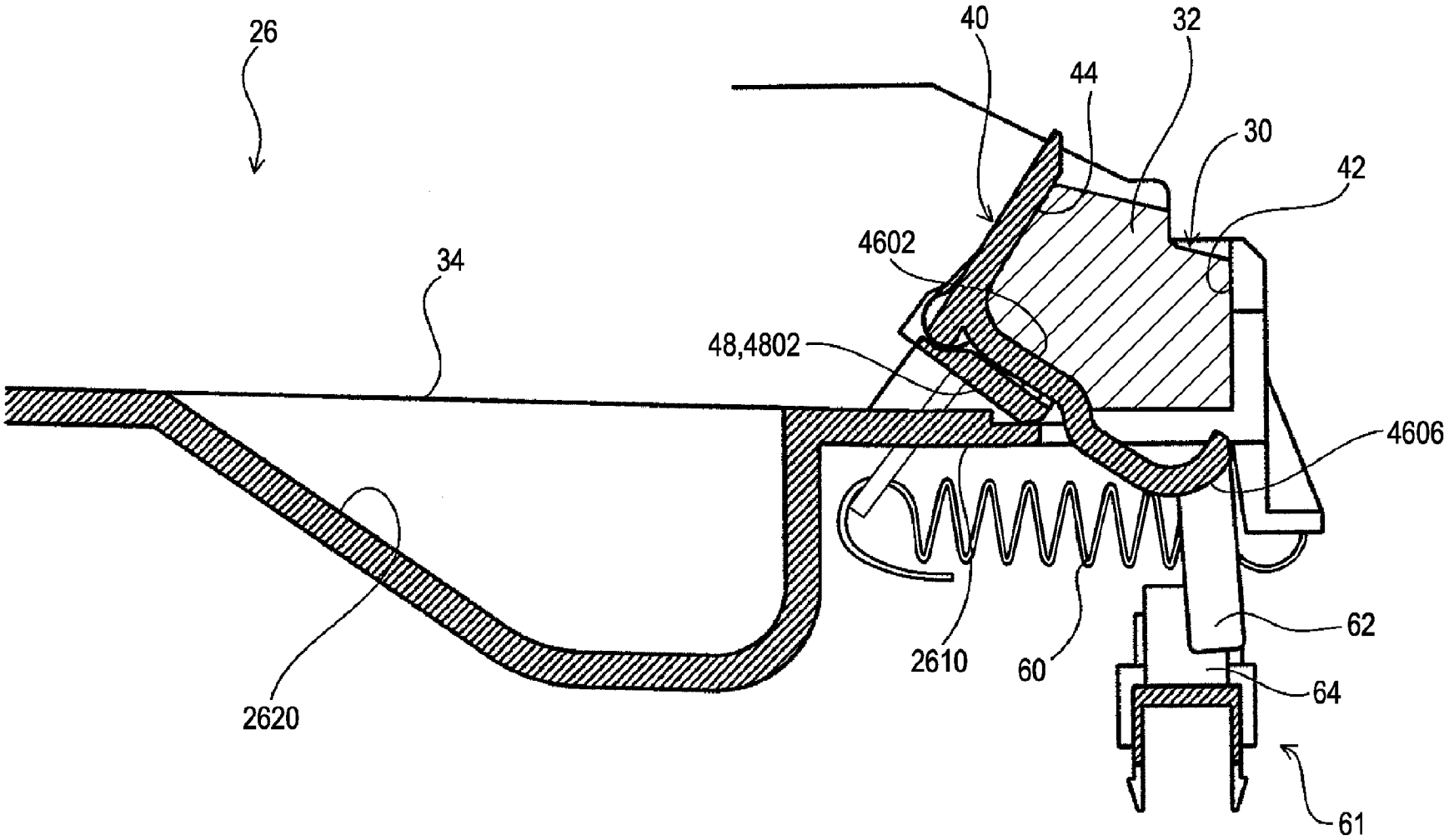
FIG. 13 shows a state of the rocking plate 40 at the second rocking position when the fragment receiving section is full.

FIG. 12 shows a state of the rocking plate 40 at the second rocking position when a fragment receiving section 32 is empty. FIG. 13 shows a state of the rocking plate 40 at the second rocking position when the fragment receiving section 32 is full.

Referring to FIG. 8, the fragment receiving section 32 that receives fragments 30 is provided below the cutter 24, and the printed matter receiving section 34 that receives printed matter 28 is provided below the cutter 24 and on the downstream side in the conveying direction with respect to the fragment receiving section 32.

In the general embodiment, the fragment receiving section 32 and the printed matter receiving section 34 are provided in the output tray 26 in such a manner as to be positioned next to each other in a direction in which the output tray 26 is fitted to or removed from the tray receiving recess 1202. Specifically, the fragment receiving section 32 is provided at a position corresponding to the head of the output tray 26 in a direction in which the output tray 26 is fitted into the tray receiving recess 1202, and the printed matter receiving section 34 is provided on the downstream side in the conveying direction with respect to the fragment receiving section 32 in a state where the output tray 26 is in the tray receiving recess 1202.

The output tray 26 has a width and a length, the length being larger than the width. The direction in which the output tray 26 is fitted into or removed from the tray receiving recess 1202 corresponds to the length direction of the output tray 26. The fragment receiving section 32 and the printed matter receiving section 34 both spread over the entire width of the output tray 26.

The fragment receiving section 32 has an open top and includes a bottom plate 33, the rocking plate 40, and an upright plate 42.

The bottom plate 33 lies below the cutting position 36.

The rocking plate 40 is provided below and on the downstream side in the conveying direction with respect to the cutting position 36 where the cutter 24 cuts the recording paper 2, and is rockable about an axis parallel to the width direction of the recording paper 2.

The rocking plate 40 serves as a wall that defines, in the conveying direction, the downstream end of the fragment receiving section 32 and the upstream end of the printed matter receiving section 34.

When a fragment 30 cut off by the cutter 24 falls, the rocking mechanism 54 rocks the rocking plate 40 to the first rocking position (shown in FIG. 8), where the upper end of the rocking plate 40 resides on the downstream side in the conveying direction with respect to the cutting position 36, thereby allowing the fragment 30 to fall into the fragment receiving section 32. When a piece of printed matter 28 cut off by the cutter 24 falls, the rocking mechanism 54 rocks the rocking plate 40 to the second rocking position (shown in FIG. 9), where the upper end of the rocking plate 40 resides on the upstream side in the conveying direction with respect to the cutting position 36, thereby guiding the piece of printed matter 28 into the printed matter receiving section 34.

Referring to FIG. 8, the rocking plate 40, in a state at the first rocking position, includes a first plate 44 extending perpendicularly (standing substantially vertically) to the bottom plate 33 and a second plate 46 extending from the lower end of the first plate 44 toward the upstream side in the conveying direction and receiving fragments 30 falling thereonto after being cut off by the cutter 24.

In the general embodiment, the upper end of the first plate 44 at the first rocking position shown in FIG. 8 resides on the downstream side in the conveying direction with respect to the cutting position 36, thereby allowing the fragment 30 to fall into the fragment receiving section 32, whereas the upper end of the first plate 44 at the second rocking position shown in FIG. 9 resides on the upstream side in the conveying direction with respect to the cutting position 36, thereby guiding the piece of printed matter 28 into the printed matter receiving section 34.

Referring to FIG. 6, the second plate 46 includes a base 4602 connected to the lower end of the first plate 44 and extending over the entire width of the rocking plate 40, first projections 4604 projecting from a plurality of positions, of the base 4602, spaced apart from each other in the width direction of the base 4602, and second projections 4606 projecting upward from the tips of the respective first projections 4604.

Referring to FIG. 5, a bottom plate 2610 of the output tray 26 has openings 2612 allowing the vertical movement of the first projections 4604 and the second projections 4606 through the bottom plate 2610 so that the rocking plate 40 can rock between the first and the second rocking positions.

In the general embodiment, referring to FIGS. 4 and 8, the bottom plate 33 of the fragment receiving section 32 includes the bottom plate 2610 of the output tray 26 and the second plate 46.

In the general embodiment, the rocking mechanism 54 includes the movable member 48 supported by the output tray 26 in such a manner as to be rockable about an axis parallel to the width direction of the recording paper 2 that is conveyed.

The rocking plate 40 rocks between the first and second rocking positions when the movable member 48 is rocked in a state where the rocking plate 40 and the movable member 48 are in contact with each other at their respective contact portions. Further, the rocking plate 40 is rockably connected to the movable member 48 in such a manner that the rocking plate 40 can also be rocked to the third rocking position (shown in FIG. 5), where the upper end of the rocking plate 40 resides at a position further toward the downstream side in the conveying direction than at the first rocking position.

Referring to FIGS. 6 to 13, the movable member 48 extends over the entire width of the output tray 26, and includes a lateral plate 4802 extending along the bottom surface of the base 4602 of the rocking plate 40 and flanges 4804 standing upright from respective ends of the lateral plate 4802.

Referring to FIG. 7, the rocking plate 40 is supported by the movable member 48 with supporting pins 4002 projecting at respective widthwise ends of the rocking plate 40, the supporting pins 4002 being rotatably fitted in pin receiving holes 4810 provided in the respective flanges 4804.

The flanges 4804 of the movable member 48 have supporting pins 50 projecting therefrom, respectively. The supporting pins 50 are rotatably fitted in pin receiving holes provided in respective sidewalls 2602 (shown in FIG. 4) of the output tray 26. In this manner, the movable member 48 and the rocking plate 40 are rockably supported by the output tray 26.

In the general embodiment, the portion of the rocking plate 40 that is to be in contact with the movable member 48 corresponds to the bottom surface of the base 4602, and the portion of the movable member 48 that is to be in contact with the rocking plate 40 corresponds to the top surface of the lateral plate 4802.

Further, screw springs 52 are provided between the rocking plate 40 and the movable member 48 so as to continuously urge the rocking plate 40 and the movable member 48 in respective directions in which the contact portion (the bottom surface of the base 4602) of the rocking plate 40 and the contact portion (the top surface of the lateral plate 4802) of the movable member 48 are in contact with each other.

The screw springs 52 are each wound around the corresponding supporting pin 4002, with one end thereof catching the rocking plate 40 and the other end thereof catching the corresponding flange 4804, whereby the rocking plate 40 is continuously urged in such a manner that the base 4602 thereof is in contact with the lateral plate 4802. Accordingly, when the movable member 48 is rocked, the rocking plate 40 rocks between the first and second rocking positions, together with the movable member 48.

The rocking plate 40 is rocked from the first rocking position to the third rocking position by being moved manually opposing the urging force applied by the screw springs 52.

Referring to FIG. 8, the lateral plate 4802 of the movable member 48 has a cut-out portion 4806 at the downstream end in the conveying direction in the top surface thereof so that the rocking plate 40 can rock between the first and third rocking positions. More specifically, the cut-out portion 4806 is provided so as to allow the lower end of the first plate 44 of the rocking plate 40 to swing about the supporting pins 4002 as the fulcrum.

Referring to FIG. 5, when the rocking plate 40 is rocked from the first rocking position to the third rocking position, fragments 30 that have been piled on the second plate 46 are raised by the second plate 46. Thus, the fragments 30 in the fragment receiving section 32 can be removed easily.

In the general embodiment, the rocking plate 40 at the third rocking position has the first plate 44 thereof leveled in such a manner as to extend parallel to the bottom plate 2610 of the output tray 26. In this state, some of the fragments 30 that have been piled on the second plate 46 slide along the first plate 44 down to the bottom plate 2610 of the output tray 26. The bottom plate 2610 of the output tray 26 has a recess 2620 (shown in FIG. 12) at a position thereof facing the longitudinal center of the first plate 44 that has been turned down. The recess 2620 helps easy removal of the fragments 30 with fingers.

Next, the configuration of the rocking mechanism 54 that rocks the rocking plate 40 and the movable member 48 will be described.

Referring to FIG. 8, the rocking mechanism 54 includes cams 56, cam followers 58, coil springs 60, and so forth.

Referring to FIG. 6, the cams 56 are fitted to a rotating shaft 66, which is supported by the housing 12, at two respective positions spaced apart from each other in the longitudinal direction of the rotating shaft 66.

Referring to FIG. 8, the cams 56 each includes a circular base portion 5602 and a rocking cam portion 5604.

In the general embodiment, the cam that moves the print head 22 between the standby position and the printing position, as described above, is also fitted to the rotating shaft 66 to which the cams 56 are fitted. Thus, the complexity, size, and manufacturing cost of the entire configuration are reduced.

Referring to FIG. 8, the cams 56 are provided in such a manner as to be positioned below the fragment receiving section 32 in a state where the output tray 26 is fitted in the tray receiving recess 1202.

The cam followers 58 project downward from the lateral plate 4802 of the movable member 48, at two respective positions spaced apart from each other in the longitudinal direction of the lateral plate 4802.

Referring to FIG. 5, the bottom plate 2610 of the output tray 26 has openings 2614 that allow the swinging movement of the cam followers 58 that move following the cams 56.

Referring to FIG. 8, the coil springs 60 are each stretched between a catch 2620 provided at an edge of the bottom surface of the output tray 26 and a catch 4812 projecting downward from the bottom surface of the movable member 48. The coil springs 60 urges the cam followers 58 in a direction in which the cam followers 58 are continuously pushed toward the cams 56.

In the general embodiment, the coil springs 60 also continuously urge, at respective widthwise ends of the lateral plate 4802 of the movable member 48, a bottom edge of the lateral plate 4802 on the downstream side in the conveying direction against the top surface of the bottom plate 2610. The position of the movable member 48 where the downstream bottom edge of the lateral plate 4802 of the movable member 48 is in contact with the top surface of the bottom plate 2610 is determined as the rocking limit of the movable member 48 in a direction in which the rocking plate 40 is moved from the second rocking position toward the first rocking position.

Referring to FIG. 8, in a case where a non-printing area is cut off, the circular base portions 5602 of the cams 56 are positioned away from the cam followers 58, whereby the downstream bottom edge of the lateral plate 4802 is brought into contact with the bottom plate 2610 because of the urging force applied by the coil springs 60. Thus, the upper end of the rocking plate 40 is positioned on the downstream side in the conveying direction with respect to the cutting position 36, that is, the rocking plate 40 is rocked to the first rocking position, allowing the non-printing area to fall as a fragment 30 into the fragment receiving section 32.

Referring to FIG. 9, in a case where a printing area is cut off, the cams 56 rotate in such a manner that the rocking cam portions 5604 thereof push the cam followers 58, whereby the cam followers 58 are rocked. Thus, the upper end of the rocking plate 40 is positioned on the upstream side in the conveying direction with respect to the cutting position 36, that is, the rocking plate 40 is rocked to the second rocking position, guiding the printing area as a piece of printed matter 28 into the printed matter receiving section 34.

A detection mechanism 61 detects whether or not the rocking plate 40 is positioned at the second rocking position.

Referring to FIGS. 6, 12, and 13, the detection mechanism 61 includes a detection piece 62 projecting from one of the plurality of second projections 4606 and a photodetector 64 provided on the housing 12 and configured to detect the presence/absence of the detection piece 62 when the rocking plate 40 is positioned at the second rocking position.

Specifically, referring to FIG. 12, when the rocking plate 40 is rocked together with the movable member 48 from the first rocking position to the second rocking position in a state where the fragment receiving section 32 has no fragments 30 therein or the amount of the fragments 30 is less than a predetermined amount, the detection piece 62 blocks detection light emitted from the photodetector 64 while the base 4602 of the rocking plate 40 is held in full contact with the lateral plate 4802 of the movable member 48. Therefore, the detection signal of the photodetector 64 becomes on.

In contrast, referring to FIG. 13, when the rocking plate 40 is rocked together with the movable member 48 from the first rocking position toward the second rocking position in a state where the fragment receiving section 32 has fragments 30 therein more than the predetermined amount, the first plate 44 of the rocking plate 40 is pressed toward the downstream side in the conveying direction by the fragments 30 stuffed in a space between the first plate 44 and the upright plate 42. This displaces the rocking plate 40 with respect to the movable member 48, opposing the urging force applied by the screw springs 52. Accordingly, the rocking plate 40 does not reach the second rocking position and is stopped before the second rocking position while the base 4602 of the rocking plate 40 is displaced in a direction away from the lateral plate 4802 of the movable member 48. In this state, the detection piece 62 is out of the range of the detection light of the photodetector 64. Therefore, the detection signal of the photodetector 64 remains off.

In this manner, whether or not the fragment receiving section 32 is full of fragments 30 can be detected in accordance with the state of the detection signal of the photodetector 64 at the time when the rocking plate 40 is rocked to the second rocking position. On the basis of such a detection operation, the printer 10 can generate an alarm indicating that the fragment receiving section 32 is full. Such an alarm generated by the printer 10 can be indicated on a display or with a lamp provided to the printer 10, or with a sound generated by a buzzer or a speaker. Alternatively, alarm information indicating that the fragment receiving section 32 is full may be transmitted to a host apparatus (a personal computer) or the like connected to the printer 10. Other existing methods for indicating an alarm may also be employed.

In the general embodiment, the first projections 4604 and the second projections 4606 of the rocking plate 40 move upward and downward with respect to the bottom plate 2610 of the output tray 26 through the openings 2612 provided in the bottom plate 2610. Therefore, the capacity of the fragment receiving section 32 when the rocking plate 40 is at the second rocking position shown in FIG. 9 is smaller than the capacity of the fragment receiving section 32 when the rocking plate 40 is at the first rocking position shown in FIG. 8.

Hence, the state of the fragment receiving section 32 that is full of fragments 30 can be detected with a smaller capacity of the fragment receiving section 32. This is advantageous in performing assured detection of the full state.

Next, a first embodiment of an output operation performed by the printer 10 will be described.

The operation starts in a state where the output tray 26 is fitted in the tray receiving recess 1202 in advance.

The recording paper 2 having non-printing areas and printing areas thereon is conveyed by the conveying section 16 along the conveying path 4 toward the cutter 24 until the recording paper 2 projects from the cutting position 36 toward the downstream side in the conveying direction by the length of a non-printing area.

After the rocking mechanism 54 rocks the rocking plate 40 from the second rocking position to the first rocking position shown in FIG. 8, the cutter 24 cuts off the non-printing area.

The non-printing area falls as a fragment 30 into the fragment receiving section 32 provided therebelow.

Subsequently, in a state where the rocking mechanism 54 holds the rocking plate 40 at the second rocking position shown in FIG. 9, the conveying section 16 conveys the recording paper 2 until the recording paper 2 projects from the cutting position 36 toward the downstream side in the conveying direction by the length of a printing area.

Then, the cutter cuts off the printing area.

The printing area falls as a piece of printed matter 28 down below into the printed matter receiving section 34.

In this step, the upstream end, in the conveying direction, of the piece of printed matter 28 comes into contact with the rocking plate 40 that is tilted, whereby the piece of printed matter 28 is guided along the tilted rocking plate 40 down toward the printed matter receiving section 34.

When the rocking mechanism 54 rocks the rocking plate 40 from the second rocking position to the first rocking position before a subsequent non-printing area is cut off, the upstream end of the piece of printed matter 28 is moved by the rocking plate 40 toward the printed matter receiving section 34, whereby the piece of printed matter 28 is assuredly placed in the printed matter receiving section 34.

Next, a second embodiment of the output operation performed by the printer 10 will be described.

Referring to FIG. 8, with the rocking plate 40 positioned at the first rocking position, a non-printing area of the recording paper 2 that has been cut off as a fragment 30 by the cutter 24 is received by the fragment receiving section 32.

Then, referring to FIG. 10, with the rocking plate 40 held at the first rocking position, a printing area of the recording paper 2 is cut off as a piece of printed matter 28 by the cutter 24.

In this case, the piece of printed matter 28 falls down below, while the upstream end, in the conveying direction, thereof being placed over the upper end of the rocking plate 40.

When the rocking mechanism 54 rocks the rocking plate 40 from the first rocking position to the second rocking position, referring to FIG. 9, the upstream end of the piece of printed matter 28 in the conveying direction comes into contact with the rocking plate 40 that is tilted, whereby the piece of printed matter 28 is guided along the tilted rocking plate 40 down toward the printed matter receiving section 34.

Subsequently, when the rocking mechanism 54 rocks the rocking plate 40 from the second rocking position to the first rocking position, referring to FIG. 11, the upstream end of the piece of printed matter 28 is moved by the rocking plate 40 toward the printed matter receiving section 34, whereby the piece of printed matter 28 is assuredly placed in the printed matter receiving section 34.

To remove fragments 30 from the fragment receiving section 32, referring to FIG. 3, the output tray 26 is pulled out of the tray receiving recess 1202 of the housing 12 toward the downstream side in the conveying direction so that the rocking plate 40 is exposed outside the output slot 13. Then, referring to FIG. 5, the rocking plate 40 is rocked from the first rocking position to the third rocking position, opposing the urging force applied by the screw springs 52.

As a result, the fragments 30 in the fragment receiving section 32 are moved from the side of the second plate 46 to the side of the first plate 44. In this state, the fragments 30 can be removed by putting a finger into the recess 2620 of the output tray 26 provided at a position facing the longitudinal center of the first plate 44 that has been turned down.

The fragments 30 can be removed without completely removing the output tray 26 from the tray receiving recess 1202, but only by pulling the output tray 26 toward the downstream side in the conveying direction from the tray receiving recess 1202 of the housing 12 by a length sufficient to expose the rocking plate 40 outside the output slot 13 so that the rocking plate 40 can be moved manually. This is advantageous in improving usability.

To summarize, according to the embodiments of the present invention, the rocking mechanism 54 rocks the rocking plate 40 between the first rocking position, where the upper end of the rocking plate 40 resides on the downstream side in the conveying direction with respect to the cutting position 36 so as to allow a fragment 30 that has been cut off by the cutter 24 to fall into the fragment receiving section 32, and the second rocking position, where the upper end of the rocking plate 40 resides on the upstream side in the conveying direction with respect to the cutting position 36 so as to guide a piece of printed matter 28 that has been cut off by the cutter 24 into the printed matter receiving section 34.

Such a simple configuration of the rocking plate 40 enables assured separation of cut pieces of printed matter 28 from fragments 30.

Therefore, it is possible to exclude an output roller, which is provided in the related-art configuration at a downstream position in the conveying direction with respect to the cutter in order to output printed matter, and a mechanism for driving the output roller. This leads to very advantageous reduction in the number of components included in a printer and in the size of the printer itself.

Moreover, according to the embodiments, the rocking plate 40 is provided in combination with the movable member 48. Therefore, the rocking plate 40 can be rocked to the third rocking position, enabling easy removal of fragments 30 in the fragment receiving section 32. This is advantageous in improving usability.

In addition, according to the embodiments, with the detection mechanism 61 that detects whether or not the rocking plate 40 is positioned at the second rocking position, the state where the fragment receiving section 32 is full of fragments 30 can also be detected. Therefore, a user can effectively know the timing for removing the fragments 30 in the fragment receiving section 32. This is also advantageous in improving usability.

While the embodiments concern the case where the rocking plate 40 and the movable member 48 are provided as separate components, the rocking plate 40 and the movable member 48 may be provided as an integral component.

While the embodiments concern the case where the rocking mechanism 54 includes the cams 56, the cam followers 58, and the coil springs 60, the rocking mechanism 54 may have any of other various related-art configurations, such as a link mechanism and a gear mechanism.

While the embodiments concern the case where the fragment receiving section 32, the printed matter receiving section 34, and the rocking plate 40 are all provided on the output tray 26, the fragment receiving section 32, the printed matter receiving section 34, and the rocking plate 40 may be provided directly to the housing 12 of the printer 10.

It should be understood by those skilled in the art that various modifications, combinations, sub-combinations and alterations may occur depending on design requirements and other factors insofar as they are within the scope of the appended claims or the equivalents thereof.

What is claimed is:

1. A printer comprising:

a conveying section that conveys paper, the paper having a width and a length orthogonal to the width, the paper having a printing area and a non-printing area provided thereon next to each other in a direction of the length, and the paper being conveyed in the direction of the length;

a cutter that cuts the paper conveyed thereto such as to separate the printing area and the non-printing area;

a fragment receiving section provided below the cutter, the fragment receiving section receiving the non-printing area cut off as a fragment by the cutter and falling into the fragment receiving section;

a printed matter receiving section provided below the cutter, the printed matter receiving section receiving the printing area cut off as a piece of printed matter by the cutter and falling into the printed matter receiving section; and an output tray, wherein, the fragment receiving section includes a rocking plate provided at a position below a cutting position where the cutter cuts the paper, the rocking plate being rockable about an axis parallel to a direction of the width of the paper, the fragment receiving section, the printed matter receiving section, and the rocking plate are provided on the output tray, the rocking plate is rocked by a rocking mechanism between (i) a first rocking position, in which an upper end of the rocking plate is distal from the cutting position so as to allow the fragment to fall into the fragment receiving section, and (ii) a second rocking position, in which the upper end of the rocking plate is proximal to the cutting position so as to guide the piece of printed matter into the printed matter receiving section on the output tray, the fragment receiving section includes a bottom plate residing below the cutting position, and the rocking plate includes a first plate and a second plate that is arranged such that when the rocking plate is at the first rocking position, the second plate is positioned such as to receive the fragment cut off by the cutter and falling thereonto, the bottom plate of the fragment receiving section including the second plate.

2. The printer according to claim 1, wherein:

at the first rocking position, the first plate stands substantially vertically, and the second plate extends from a lower end of the first plate and is positioned such as to receive the fragment cut off by the cutter and falling thereonto, and the rocking mechanism causes, at the first rocking position, an upper end of the first plate to be positioned distally from the cutting position so as to allow the fragment to fall into the fragment receiving section, and, at the second rocking position, the upper end of the first plate to be positioned proximately to the cutting position so as to guide the piece of printed matter along the first plate into the printed matter receiving section on the output tray.

3. The printer according to claim 1, wherein the fragment receiving section further includes an upright plate standing upright with respect to at least a portion of the bottom plate.

4. The printer according to claim 1, wherein:

the rocking mechanism includes (a) a cam rotatably driven, a cam follower projecting from the rocking plate and configured to be pushed by and separated from the cam, and (b) a spring urging the cam follower in a direction in which the cam follower is to be pushed by the cam, the rocking plate rocks from the first rocking position to the second rocking position when the cam follower is pushed by a rocking cam portion of the cam, and a detection mechanism detects whether the rocking plate is positioned at the second rocking position.

5. The printer according to claim 1, wherein:

the rocking plate is at the first rocking position when the fragment cut off by the cutter falls, and at the second rocking position when the piece of printed matter cut off by the cutter falls.

6. A printer comprising:

a conveying section that conveys paper, the paper having a width and a length orthogonal to the width, the paper having a printing area and a non-printing area provided thereon next to each other in a direction of the length, and the paper being conveyed in the direction of the length;

a cutter that cuts the paper conveyed thereto such as to separate the printing area and the non-printing area;

a fragment receiving section provided below the cutter, the fragment receiving section receiving the non-printing area cut off as a fragment by the cutter and falling into the fragment receiving section;

a printed matter receiving section provided below the cutter, the printed matter receiving section receiving the printing area cut off as a piece of printed matter by the cutter and falling into the printed matter receiving section;

a housing; and an output tray, wherein, the fragment receiving section includes a rocking plate provided at a position below a cutting position where the cutter cuts the paper, the rocking plate being rockable about an axis parallel to a direction of the width of the paper, the rocking plate is rocked by a rocking mechanism between (i) a first rocking position, in which an upper end of the rocking plate is distal from the cutting position so as to allow the fragment to fall into the fragment receiving section, and (ii) a second rocking position, in which the upper end of the rocking plate is proximal to the cutting position so as to guide the piece of printed matter into the printed matter receiving section, the output tray receives the piece of printed matter, the output tray is detachably attached to the housing, the rocking plate is provided on the output tray, the fragment receiving section includes a bottom plate residing below the cutting position, and the rocking plate includes a first plate and a second plate that is arranged such that when the rocking plate is at the first rocking position, the second plate is positioned such as to receive the fragment cut off by the cutter and falling thereonto, the bottom plate of the fragment receiving section including the second plate.

7. A printer comprising:

a conveying section that conveys paper, the paper having a width and a length orthogonal to the width, the paper having a printing area and a non-printing area provided thereon next to each other in a direction of the length, and the paper being conveyed in the direction of the length;

a cutter that cuts the paper conveyed thereto such as to separate the printing area and the non-printing area;

a fragment receiving section provided below the cutter, the fragment receiving section receiving the non-printing area cut off as a fragment by the cutter and falling into the fragment receiving section;

a printed matter receiving section provided below the cutter, the printed matter receiving section receiving the printing area cut off as a piece of printed matter by the cutter and falling into the printed matter receiving section;

a housing; and an output tray, wherein, the fragment receiving section includes a rocking plate provided at a position below a cutting position where the cutter cuts the paper, the rocking plate being rockable about an axis parallel to a direction of the width of the paper, the rocking plate is rocked by a rocking mechanism between (i) a first rocking position, in which an upper end of the rocking plate is distal from the cutting position so as to allow the fragment to fall into the fragment receiving section, and (ii) a second rocking position, in which the upper end of the rocking plate is proximal to the cutting position so as to guide the piece of printed matter into the printed matter receiving section, the output tray receives the piece of printed matter, the output tray has a bottom plate and is detachably attached to the housing, the fragment receiving section includes a bottom plate residing below the cutting position, the rocking plate is provided on the output tray, the rocking plate, in a state at the first rocking position, includes (i) a first plate standing perpendicularly to the bottom plate of the fragment receiving section, and (ii) a second plate extending from a lower end of the first plate and positioned such as to receive the fragment cut off by the cutter and falling thereonto, the rocking mechanism causes, at the first rocking position, an upper end of the first plate to be positioned distally from the cutting position so as to allow the fragment to fall into the fragment receiving section, and, at the second rocking position, the upper end of the first plate to be positioned proximately to the cutting position so as to guide the piece of printed matter along the first plate into the printed matter receiving section, the bottom plate of the fragment receiving section includes the bottom plate of the output tray and the second plate, and the bottom plate of the output tray has an opening through which the second plate passes when the rocking plate is rocked.

8. A printer comprising:

a conveying section that conveys paper, the paper having a width and a length orthogonal to the width, the paper having a printing area and a non-printing area provided thereon next to each other in a direction of the length, and the paper being conveyed in the direction of the length;

a cutter that cuts the paper conveyed thereto such as to separate the printing area and the non-printing area;

a fragment receiving section provided below the cutter, the fragment receiving section receiving the non-printing area cut off as a fragment by the cutter and falling into the fragment receiving section;

a printed matter receiving section provided below the cutter, the printed matter receiving section receiving the printing area cut off as a piece of printed matter by the cutter and falling into the printed matter receiving section;

a housing; and an output tray, wherein, the fragment receiving section includes a rocking plate provided at a position below a cutting position where the cutter cuts the paper, the rocking plate being rockable about an axis parallel to a direction of the width of the paper, the rocking plate is rocked by a rocking mechanism between (i) a first rocking position, in which an upper end of the rocking plate is distal from the cutting position so as to allow the fragment to fall into the fragment receiving section and (ii) a second rocking position, in which the upper end of the rocking plate is proximal to the cutting position so as to guide the piece of printed matter into the printed matter receiving section, the output tray receives the piece of printed matter, the output tray is detachably attached to the housing, the rocking mechanism includes a movable member supported by the output tray in such a manner as to be rockable about an axis parallel to the direction of the width of the paper that is conveyed, the rocking plate rocks between the first and second rocking positions when the movable member is rocked in a state where the rocking plate and the movable member are in contact with each other at respective contact portions thereof, the rocking plate being rockably connected to the movable member in such a manner as to be rockable to a third rocking position in which the upper end of the rocking plate is positioned different from the first rocking position for removal of fragments from the fragment receiving section, the rocking plate and the movable member are continuously urged by a spring in respective directions in which the contact portions thereof are to be in contact with each other, and the rocking plate is rocked from the first rocking position to the third rocking position by being moved manually opposing an urging force applied by the spring.

* * * * *